US007581727B2

(12) United States Patent
Iesaki

(10) Patent No.: US 7,581,727 B2
(45) Date of Patent: Sep. 1, 2009

(54) RECORDING MEDIUM CONVEYING DEVICE

(75) Inventor: Kenichi Iesaki, Inazawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 209 days.

(21) Appl. No.: 11/688,574

(22) Filed: Mar. 20, 2007

(65) Prior Publication Data

US 2007/0228641 A1 Oct. 4, 2007

(30) Foreign Application Priority Data

Mar. 30, 2006 (JP) ..... 2006-094200

(51) Int. Cl.
*B65H 5/00* (2006.01)

(52) U.S. Cl. ..... 271/10.02; 271/265.01; 271/264; 271/10.01

(58) Field of Classification Search ..... 271/264, 271/10.11, 109, 272, 265.01, 10.01, 10.02
See application file for complete search history.

(56) References Cited

U.S. PATENT DOCUMENTS 6,168,270 B1 * 1/2001 Saikawa et al. ..... 347/104
2006/0022401 A1 * 2/2006 Akiyama et al. ..... 271/265.01
2007/0152396 A1 * 7/2007 Tanahashi et al. ..... 271/109
2007/0152398 A1 * 7/2007 Watanabe ..... 271/264

FOREIGN PATENT DOCUMENTS

JP 7295311 11/1995

* cited by examiner

*Primary Examiner*—Kaitlin S Joerger
(74) *Attorney, Agent, or Firm*—Banner & Witcoff, Ltd.

(57) ABSTRACT

According to an aspect of the present invention, a recording medium conveying device includes a feeding roller that feeds a recording medium, a conveying guide that guides the recording medium fed by the feeding roller in a U-shape, a conveying roller that conveys the recording medium passing through the conveying guide toward a target position, a driving unit that drives the feeding roller and the conveying roller, and a controller that is operable to estimate a conveyance load borne on the recording medium at a time after a start of feeding the recording medium and before an arrival of the record medium at the conveying roller, and generate an operation amount of the driving unit to drive the conveying roller based on the estimated conveyance load.

6 Claims, 7 Drawing Sheets

RECORDING MEDIUM CONVEYING DEVICE

CROSS-REFERENCE TO RELATED APPLICATION

This application claims priority from Japanese Patent Application No. 2006-094200, filed on March 30, 2006, the entire subject matter of which is incorporated herein by reference.

TECHNICAL FIELD

Aspects of the present invention relates to a recording medium conveying device, and particularly to a recording medium conveying device in which the accuracy of conveying a recording medium can be improved.

BACKGROUND

Conventionally, recording apparatuses having recording unit that records on a recording medium includes a recording medium conveying device. Also, the recording medium conveying device includes a conveying roller that conveys the recording medium toward the recording unit and a feeding roller that feeds the recording medium to the conveying roller. As for such a kind of a recording medium conveying device, for example, JP-H07-295311 (paragraph [0014], FIG. 1, etc.) discloses a conveying device including a pair of conveying rollers that conveys an image supporting body toward a photosensitive drum and a pickup roller that feeds the image supporting body to the pair of conveying rollers. JP-H7-295311 also discloses a technique for conveying rollers with a high degree of accuracy. In the technique, the thickness of the image supporting body is estimated by detecting the peak value of a current to drive the pair of conveying rollers in accordance with the estimated thickness of the image supporting body.

However, since the technique described in the JP-H7-295311 the thickness of the image supporting body is estimated by detecting the peak value of a driving current to be output for the pair of conveying rollers, the peak value of the driving current can be detected only after conveying is started by the pair of conveying rollers. Therefore, the pair of conveying rollers can not be controlled appropriately until the peak value of the driving current is detected and reflected to the pair of conveying rollers. This results in a problem that the image supporting body still can not be conveyed with a high degree of accuracy.

In addition to the conveying device described in JP-H7-295311, there has been known, for example, a recording medium conveying device including a conveying guide that conveys a recording medium in a U shape disposed between a conveying roller and a feeding roller. In the recording medium conveying device including the conveying guide, a flattened recording medium is deformed into a U shape to be conveyed, which causes a back tension due to the deformation of the recording medium.

Here will be described the back tension with reference to FIGS. 7A and 7B. FIGS. 7A and 7B are schematic views showing the internal mechanism of a recording medium conveying device 100 including a conveying guide 102, where FIG. 7A shows a state where a recording medium P is conveyed and FIG. 7B shows a state where the conveying of the recording medium P is stopped.

In the recording medium conveying device 100, the recording medium P is supplied and conveyed by a supply roller 101 while being bent into a U shape along the conveying guide 102. When the recording medium P is conveyed by the supply roller 101, the conveying roller 103 rotates in the same direction as the supply roller 101. Then, when a registering sensor 104 detects the recording medium P, the conveying roller 103 starts a reverse rotation (indicated by the arrow in FIG. 7A) to convey the recording medium P toward a target position.

During the conveying roller 103 conveys the recording medium P, the recording medium P is bent as shown in FIG. 7A. Therefore, a repulsive force acts on the recording medium P is borne on the conveying direction H, through which the recording medium P is conveyed by the conveying roller 103, as a back tension T. This deteriorates a conveying accuracy. In addition, when conveying roller 103 stops the conveying of the recording medium P as shown in FIG. 7B, the force in the conveying direction H by the conveying roller 103 becomes zero. Therefore, the effect of the back tension T becomes larger. This acts to the recording medium P to be returned from a desired stop position and also deteriorates a conveying accuracy when the recording medium is conveyed again.

The technique described in JP-H7-295311 the pair of conveying rollers is controlled in accordance with the thickness of the image supporting body. However, in such a kind of a recording medium conveying device in which a recording medium is deformed into a U shape to be conveyed, the deterioration of the conveying accuracy in accordance with the thickness of the recording medium is not necessarily appropriate to consider. The deterioration of the conveying accuracy due to the back tension T is more of a problem.

SUMMARY

According to an aspect of the present invention, there is provided a recording medium conveying device including a feeding roller that feeds a recording medium, a conveying guide that guides the recording medium fed by the feeding roller in a U-shape, a conveying roller that conveys the recording medium passing through the conveying guide toward a target position, a driving unit that drives the feeding roller and the conveying roller, and a controller that is operable to estimate a conveyance load borne on the recording medium at a time after a start of feeding the recording medium and before an arrival of the record medium at the conveying roller, and generate an operation amount of the driving unit to drive the conveying roller based on the estimated conveyance load.

DESCRIPTION

Hereinafter, examples of the present invention will be described with reference to the drawings.

Figure 1:
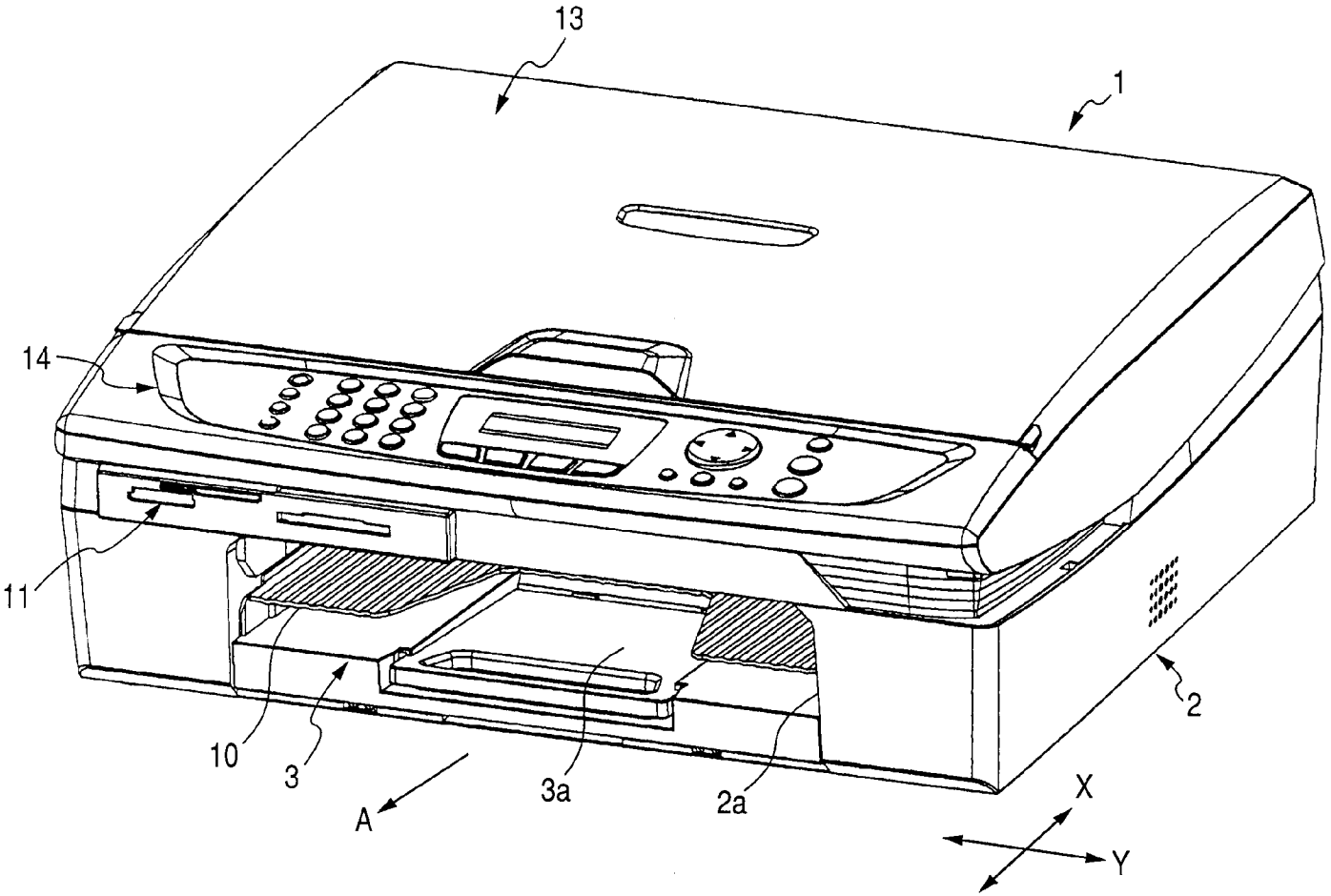
FIG. 1 is a perspective view of a multifunction peripheral apparatus that includes a recording medium conveying device according to the present invention.
Figure 2:
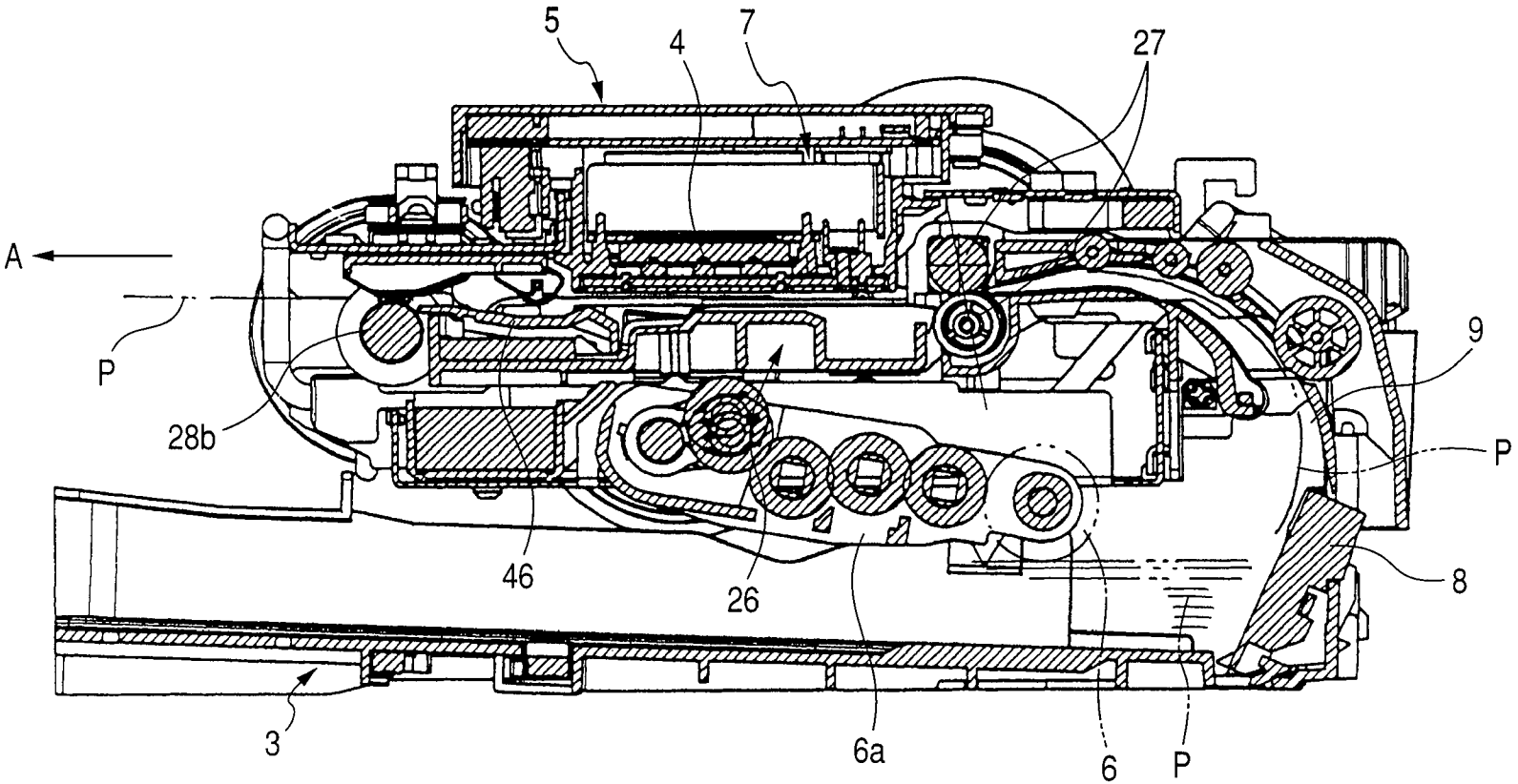
FIG. 2 is a cross-sectional view of a printer section in the multifunction peripheral apparatus according to the present invention.

FIG. 1 is a perspective view of a multifunction peripheral apparatus 1 that includes a recording medium conveying device according to the example when observed from the front, and FIG. 2 is a cross-sectional view of a printer structural part equipped in the multifunction peripheral apparatus 1. While the multifunction peripheral apparatus 1 has functions as a printer, copier, scanner, and facsimile, the present invention may be an ink-jet printer simply having a function as a printer.

As shown in FIG. 1, the inside of the opening 2*a* in the front (near side in FIG. 1) of the housing 2 of the multifunction peripheral apparatus 1 is partitioned into upper and lower parts. A detachable sheet feeding cassette 3 that feeds recording media (recording sheet P) is arranged in the lower part of the opening 2*a*. The upper part of the opening 2*a* forms a sheet discharge section 10 where recorded sheet P is discharged in the direction indicated by arrow A.

The sheet feeding cassette 3 is capable of housing therein a plurality of sheets as recording media (recording sheet) in a stacked condition. The recording sheet P housed therein is cut into, for example, A4, letter, or postcard size. In the sheet feeding cassette 3, the recording media are laid one on top of another, and the state that the short side thereof is adjusted to be along with in the main scanning direction (Y-axis direction, i.e., perpendicular to the X-axis direction that is sheet conveying direction).

On a top of the housing 2, an image scanning device that scans a document when performing the copy function or the facsimile function is arranged. The image scanning device is configured to be vertically rotatable to the one side end of the housing 2 via an axial portion (not shown). On a top of the image scanning device, a sheet covering body 13 covering the upper surface of the image scanning device and centering on the axial portion is attached to be vertically rotatable to the rear end of the image scanning device. Below the placing glass plate, a scanner (e.g. CIS: Contact Image Sensor) 70 (refer to FIG. 3) that scans a sheet is provided movably back-and-forth in the main scanning direction (Y-axis direction). It is then arranged that the paper covering body 13 is opened upward to place paper on the placing glass plate and images on the paper are scanned.

In the upper part of the housing 2, a control panel 14 including various operation buttons in front of the sheet covering body 13 and a liquid crystal display device (hereinafter referred to as "LCD") 15 that displays operation procedures and the state of running processes are provided. In the front surface of the housing 2 and below the control panel 14, an external memory insertion port 11 in which an external memory is inserted is provided thereinto. The external memory is, for example, a Compact Flash (registered trademark), Smart Media (registered trademark), Memory Stick (registered trademark), SD Card (registered trademark), or xD Card (registered trademark).

Figure 3:
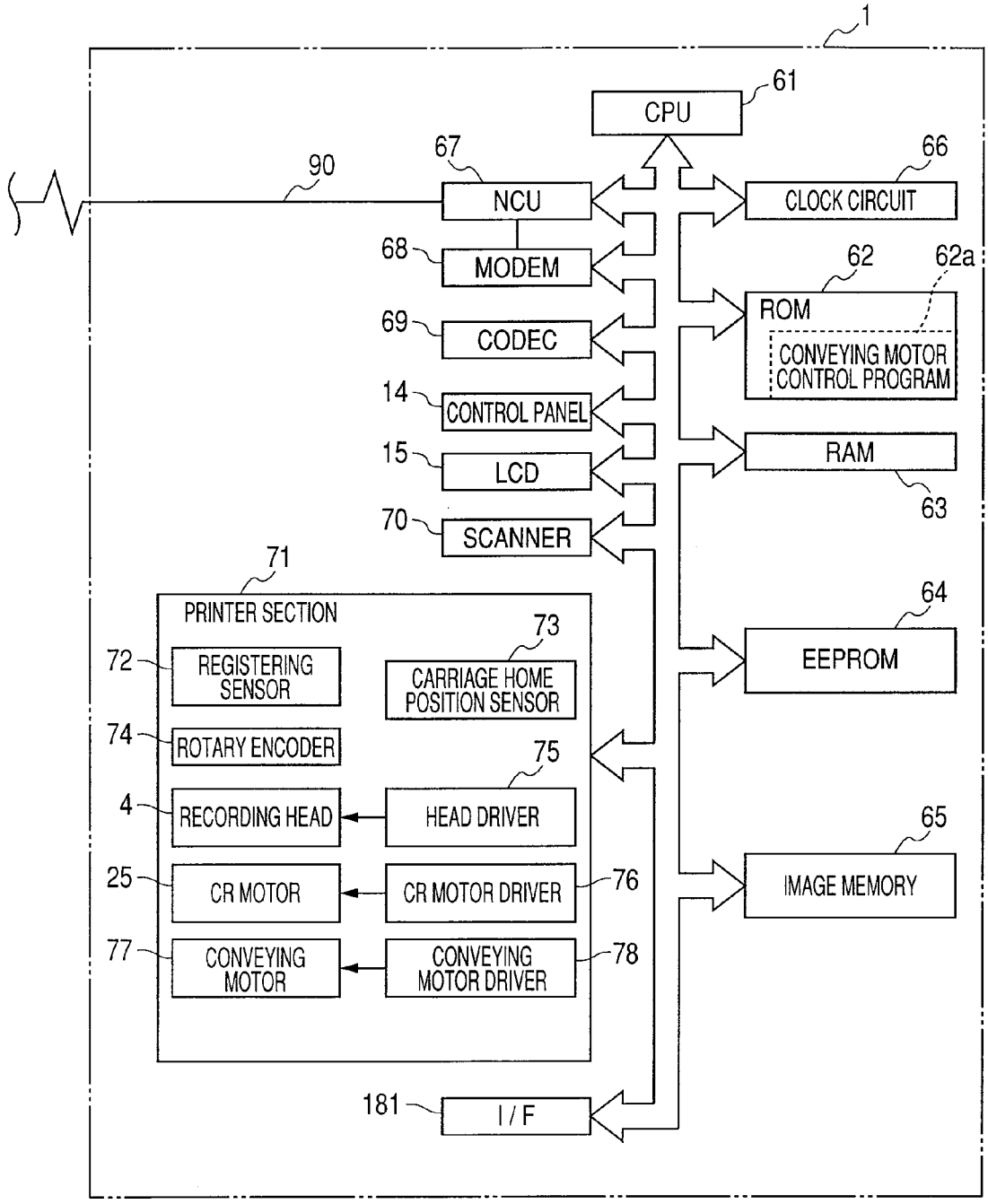
FIG. 3 is a block diagram showing the electrical configuration of the multifunction peripheral apparatus.

As shown in FIG. 2, the multifunction peripheral apparatus 1 includes a printer section 71 that records on the recording sheet P (also refer to FIG. 3). Below the printer section 71 and on the far side of the sheet feeding cassette 3 (right side in FIG. 2), a bank portion 8 that separates one sheet from the stacked sheets is arranged. In a position nearer the front surface of the housing 2 than the bank portion 8 (on the upstream side in the conveying direction and the feeding direction of the recording sheet P), an arm 6*a* is installed. The upper end portion of the arm 6*a* is vertically rotatable. On the lower end of the arm 6*a*, a sheet feeding roller 6 is provided. The sheet feeding roller 6 is configured to contact with the uppermost one recording sheet P housed in the sheet feeding cassette 3.

When the sheet feeding roller 6 is driven in the sheet feeding direction (counterclockwise in FIG. 2), the bank portion (tilted separation plate) 8 separates and conveys the recording sheet P as recording media laid on top in the sheet feeding cassette 3 one by one. The sheet feeding roller 6 conveys the separated recording sheet P to a conveying roller 27 that is provided in the rear of and above (in a position higher than that of) the sheet feeding cassette 3 via a vertically- and laterally-facing U-turn path (feed path) 9.

The printer section also includes: an ink-jet type recording head 4 that records on the recording sheet P; a carriage 5 equipped with the recording head 4 and movable back-and-forth in the main scanning direction; a timing belt arranged parallel on the upper surface of a guiding member that is arranged on the downstream side in the sheet conveying direction (indicated by arrow A) to move the carriage 5 back-and-forth; a CR (carriage) motor 25 that drives the timing belt to drive the carriage (DC motor in the aspect, but may be another kind of motor such as stepping motor (refer to FIG. 3)); an approximately flattened plate-shaped platen 26 that supports the recording sheet P conveyed through the lower surface side of the recording head 4; and an encoder strip arranged in an extending manner in the main scanning direction (Y-axis direction) to detect the position of the carriage 5 in the Y-axis direction (main scanning direction).

The encoder strip is shaped in a band-shape, and the inspection surface thereof (on which slits arranged at a constant spacing in the Y-axis direction are formed) is arranged to run vertically. In one end portion of the encoder strip in the Y-axis direction of the carriage 5A, the origin (home position) is predetermined. On the origin of the carriage 5A, a carriage home position sensor 73 that detects whether the carriage 5 is set in the home position is disposed (refer to FIG. 3).

The printer section includes a conveying roller 27 that conveys the recording sheet P conveyed by the sheet feeding roller 6 to the lower surface of the recording head 4. The printer section also includes a conveying motor that drives the conveying roller 27 and the sheet feeding roller 6 (refer to FIG. 3) via a gear. The conveying roller 27 has a pair of upper and lower rollers, where the upper one is a driving roller to be driven by the conveying motor 77 (refer to FIG. 3) and the lower one is a driven roller to be driven by the rotation of the upper roller. When the conveying roller 27 rotates in the sheet conveying direction, the upper roller thereof rotates clockwise, while the lower roller rotates counterclockwise. The recording sheet P is conveyed by the conveying roller 27 to the lower surface of the recording head 4 that is provided on the downstream side of the conveying roller 27 in the conveying direction, i.e., on the platen 26.

In the vicinity of the conveying roller 27 and in an upper position on the upstream side in the conveying direction, a registering sensor 72 that detects the arrival of the recording sheet P conveyed by the sheet feeding roller 6 is disposed. The registering sensor 72 is a common reflective light sensor including a light-emitting diode and a phototransistor. If the arrival of the recording sheet P is not detected by the registering sensor 72 during the feeding of the recording sheet P by the sheet feeding roller 6, the driving system including the sheet feeding roller 6 and conveying roller 27, etc., stops and displays an error message.

On the downstream side with respect to the platen 26, a spur roller (not shown) that contacts with the upper surface of the recording sheet P and a sheet discharge roller 28*b* on the lower surface side of the spur roller are disposed. The spur roller is a driven roller to be driven and rotated by the paper discharge roller 28*b*, and both of the spur roller and the sheet discharge roller 28*b* are rotatable forward and reverse (in the paper feed direction and the reverse thereof). In the aspect, the recording paper P is to be conveyed intermittently by driving the conveying roller 27, spur roller (not shown) and paper discharge roller 28*b* on and off in the paper feeding direction.

The printer section 71 also includes: ink cartridges respectively containing four colors of ink (black (BK), cyan (C), magenta (M), yellow (Y)) for full-color recording; a plurality of ink supply tubes that supply ink from each ink cartridge to the recording head 4; a flushing section that flushes ink (discharges ink) periodically to prevent the nozzle clogging during a recording operation; and a maintenance unit that performs recovery processing such as a cleaning of the nozzle surface of the recording head 4 and bubble removal in a buffer tank on the recording head 4 (not shown).

Next, the electrical configuration of the multifunction peripheral apparatus 1 will be described based on the block diagram in FIG. 3. FIG. 3 is a block diagram showing the electrical configuration of the multifunction peripheral apparatus 1. The multifunction peripheral apparatus 1 includes a CPU 61, ROM 62, RAM 63, EEPROM 64, image memory 65, clock circuit 66, network control unit (hereinafter referred to as "NCU") 67, modem 68, CODEC 69, scanner 70, printer section 71, interface (I/F) 181, control panel 14, and LCD 15. These components are connected with each other via a bus line, etc. The multifunction peripheral apparatus 1 also includes various devices necessary to fulfill the functions as a printer, copier, scanner, and facsimile such as an audio LSI, buffer, and amplifier.

The NCU 67 performs line control, and the multifunction peripheral apparatus 1 is connected to a telephone line (general public line) 90 via the NCU 67. The NCU 67 receives various signals such as a ringing signal and a signal indicating the telephone number (caller ID) of the other end apparatus (caller) that are sent from a switchboard on the general public line, transmits a dial signal on calling in accordance with the operation of buttons on the control panel 14 to a switchboard and transmits and receives analog audio signals while talking. The NCU 67 automatically answers to incoming calls from the telephone line 90 during data reception and automatically calls to the other end during data transmission. The CPU 61 provides digital data indicating the number of the other end to the NCU 67.

The CPU 61 as a processor controls the respective components connected via the bus line, etc., in accordance with various signals transmitted and received via the NCU 67, to perform data communication in the facsimile and telephone operations, and to perform printing (recording on the recording sheet P) of facsimile data (including image information) transmitted via the telephone line 90 and print data inputted from a personal computer or an external memory that is connected via the interface 181.

The CPU 61 controls, for example, the discharge of ink droplets and the detection of the remaining amount or existence of ink in each cartridge in accordance with control programs that are preliminarily stored in the ROM 62. The CPU 61 generates a discharge timing signal and a reset signal and then to transfer the signals to a gate array (not shown). The CPU 61 is connected with each device provided in the multifunction peripheral apparatus 1, and controls operation of each device.

Figure 5:
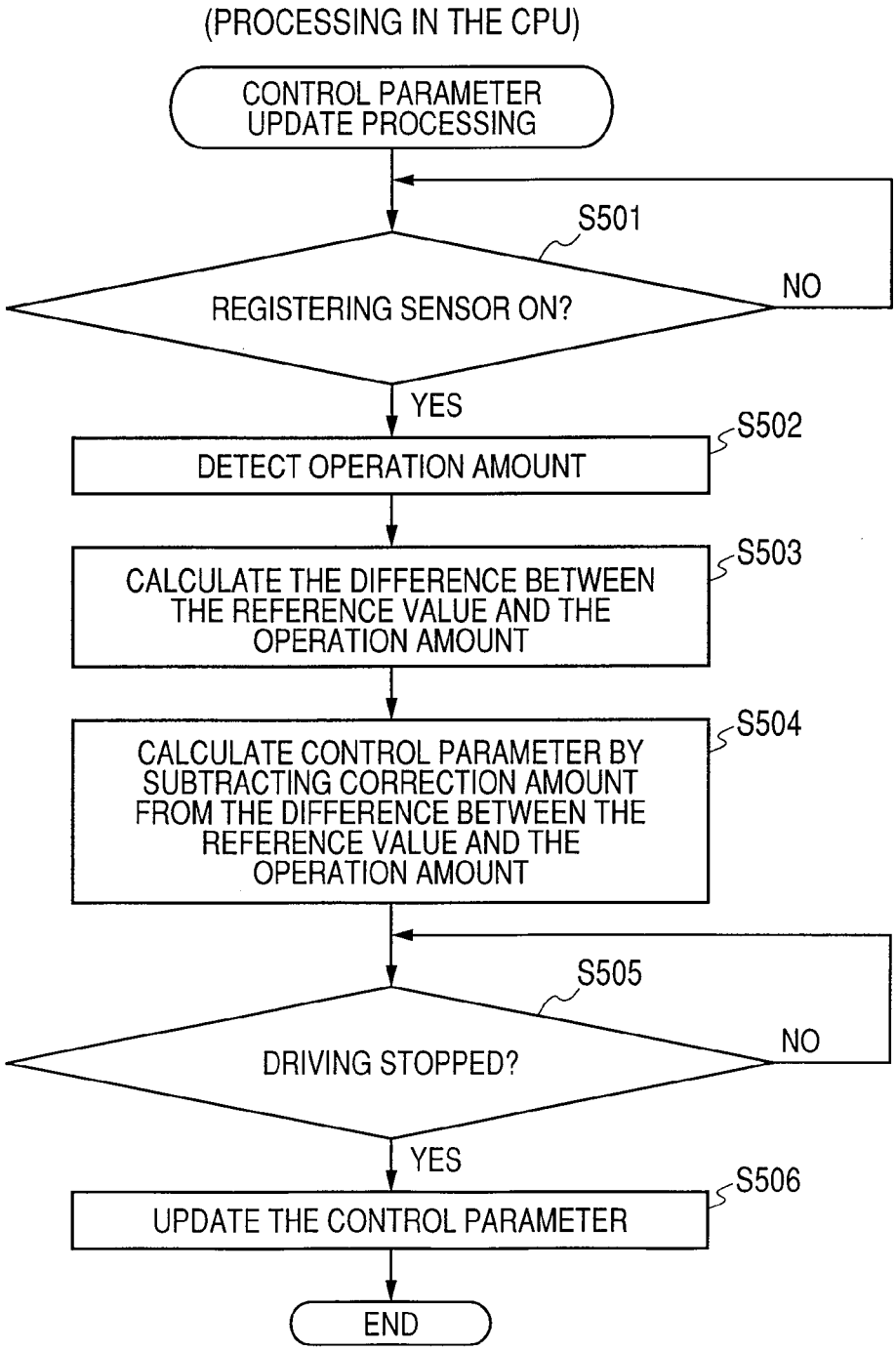
FIG. 5 is a flowchart of control parameter update processing.

The ROM 62 is a non-rewritable memory storing therein control programs to be executed in the multifunction peripheral apparatus 1 and fixed values, etc., and the control parameter update processing shown in FIG. 5 is performed in accordance with a conveying motor control program 62*a* stored in the ROM 62. The RAM 63 is a volatile memory for temporarily storing therein various data when executing programs stored in the ROM 62. The EEPROM 64 is a rewritable non-volatile memory, so that data stored in the EEPROM 64 is held even after the multifunction peripheral apparatus 1 is turned off.

The clock circuit 66 measures time and includes a clock at a predetermined frequency, a frequency divider circuit and a counter to be updated one by one (within a predetermined range), for example, every trailing edge of a pulse output from the frequency divider circuit. Time (i.e. value counted by the counter) measured by the clock circuit 66 is to be read out by the CPU 61 to be used for each processing.

The modem 68 is a modulator/demodulator connected to the NCU 67 and converts analog data (data including encoded image information, etc.) transmitted via the telephone line 90 into digital data as well as to convert digital data (data including encoded image information, etc.) to be output from the multifunction peripheral apparatus 1 to the telephone line 90 into analog data. Therefore, the modem 68 has modulation and demodulation mechanisms as well as an audio reproduction mechanism for reproducing voice from transmitted audio analog data. The modem 68 also transmits and receives various procedure signals for transmission control and includes a transmission buffer and a reception buffer to be used for temporarily storing data when transmitting and receiving the data to/from the other end apparatus.

The CODEC 69 encodes image information read by the scanner 70 and decodes encoded image information received via the telephone line 90, and the decoded data (image information) is recorded on the recording sheet P by the printer section 71.

The image memory 65 stores bit images (bit data) for recording and is composed of dynamic RAMs (DRAMs), inexpensive high-capacity memory. Data (image information) decoded by the CODEC 65 is once stored in the image memory 65 and recorded on the recording sheet P by the printer section 71, and then deleted from the image memory 65. The image memory 65 also stores image information read by the scanner 70. The image information read by the scanner 70 is deleted from the image memory 65 after being encoded by the CODEC 65 and output to the telephone line 90.

The printer section 71 records (prints) on the recording sheet P that is fed into the multifunction peripheral apparatus 1. The printer section 71 includes a registering sensor 72, a carriage home position sensor 73, a rotary encoder 74, a recording head 4, a head driver 75 that drives the recording head 4, a CR motor 25, a CR motor driver 76 that controls the CR motor 25, a conveying motor 77 that drives the sheet feeding roller 6 and conveys roller 27, and a conveying motor driver 78 that controls the drive of the conveying motor 77.

The rotary encoder 74 is a light sensor capable of detecting the rotation amount of the conveying motor 77. In the aspect, the rotary encoder 74 outputs a pulse signal for the every predetermined rotation amount of the upper roller of the conveying roller 27. Therefore, the rotation amount of the conveying motor 77 is grasped and the conveying of the recording medium is controlled.

The head driver 75 as a driving circuit that applies a drive pulse having a waveform appropriate to a signal output from the gate array (not shown) to a drive element corresponding to each nozzle in accordance with the signal. According to the drive pulse, the drive element is operated to cause each nozzle to discharge ink droplets.

The CR motor driver 76 and conveying motor driver 78 are circuits connected, respectively, to the CR motor 25 and conveying motor 77 to output currents to the respective connected motors 25 and 77.

The interface 181 is a device that is standards of electrical contact and connects different devices. The multifunction peripheral apparatus 1 is connected to other devices such as a personal computer and a local area network (LAN) via the interface 181 to perform data transmission and reception (print data reception) between the personal computer and LAN. The received print data is converted into image information (bit image) to be written into the image memory 65. Also, the external memory insertion port 11 is a connector connected to the CPU 61 via the bus line.

Figure 4:
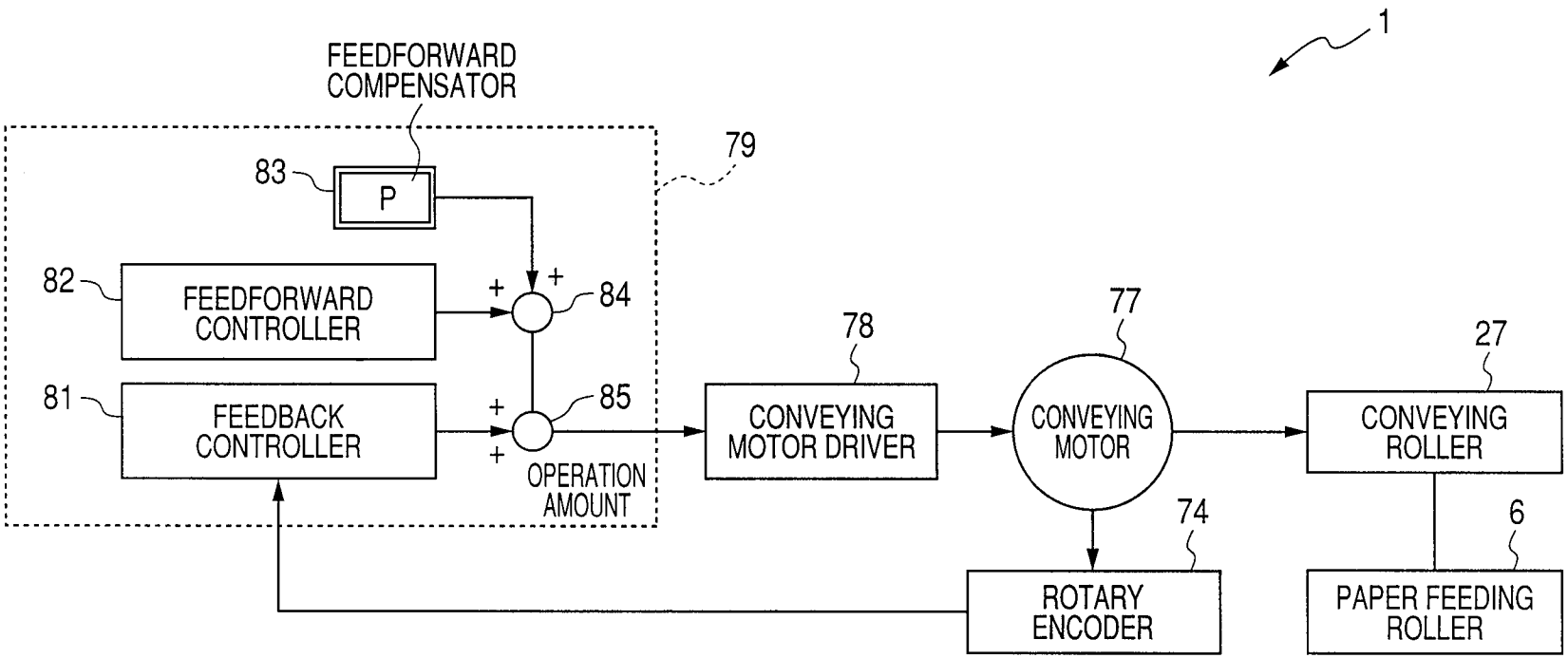
FIG. 4 is a functional block diagram of the recording medium conveying device.

Next will be described the functions of the present invention with reference to FIG. 4. FIG. 4 is a functional block diagram of the present invention. The multifunction peripheral apparatus 1 has a recording medium conveying device according to the aspect of the present invention. The recording medium conveying device includes a controller 79 in addition to the above-described sheet feeding roller 6, the conveying roller 27, the conveying motor 77, the conveying motor driver 78 and the rotary encoder 74.

The controller 79 includes: a feedback controller 81; a feedforward controller 82; a feedforward compensator 83; a first comparator 84 that compares a feedforward signal output from the feedforward controller 82 with a feedforward compensation signal output from the feedforward compensator 83; and a second comparator 85 that compares a comparison signal output from the first comparator 84 with a feedback signal output from the feedback controller 81.

The feedback controller 81 outputs a feedback signal for correcting the error between the rotation amount of the conveying motor 77 transmitted from the rotary encoder 74 and a preset rotation amount as a reference amount to the second comparator 85. The feedforward controller 82 outputs a preset operation amount (current command value) to the first comparator 84 as a feedforward signal. The feedforward compensator 83 outputs a first control parameter to the first comparator 84 as a feedforward compensation signal when the recording medium P is conveyed by the paper feeding roller 6, while outputs a second control parameter to be updated in the control parameter update processing shown in FIG. 5 to the first comparator 84 as a feedforward compensation signal after the conveying by the conveying roller 27 is started.

The controller 79 is able to generate an operation amount ("current command value": the same applies hereinafter) considering the actual conveyance load by the feedback controller 81. However, the operation amount taking into account the actual conveyance load can be generated only after the deterioration of the rotation amount of the conveying motor 77 due to a back tension was occur. Therefore, there is a delay between the occurrence of the reduction of the rotation amount and the generation of the operation amount taking into account the actual conveyance load.

In the aspect, conveyance load due to a back tension is estimated before the conveying by the conveying roller 27 is started and while the recording medium P is conveyed by the sheet feeding roller 6, a control parameter for canceling conveyance load is obtained from the estimated conveyance load, and the obtained control parameter is output from the feedforward compensator 83 before the conveying by the conveying roller 27 is started. Therefore, the conveying roller 27 is able to convey the recording medium P with a high degree of accuracy as the case where there is no conveyance load.

Next will be described the control parameter update processing with reference to FIG. 5. In the control parameter update processing, a control parameter as a feedforward compensation signal output from the feedforward compensator 83 by the CPU 61 is updated in accordance with the conveying motor control program 62*a* stored in the ROM 62 (refer to FIG. 4).

In the processing, it is determined whether the registering sensor 72 is turned "ON" (S501), and if not "ON" (S501: No), the processing of S501 is repeated until it turns "ON." That is, the processing is performed when the registering sensor 72 is turned "ON." When the registering sensor 72 is turned "ON" (S501: Yes), an operation amount to be output to the conveying motor 77 is detected (S502) and the difference between the detected operation amount and a reference amount is calculated (S503). That is, the conveyance load when the recording medium P is conveyed by the sheet feeding roller 6 is calculated and estimated by the processing of S503.

Figure 6A:
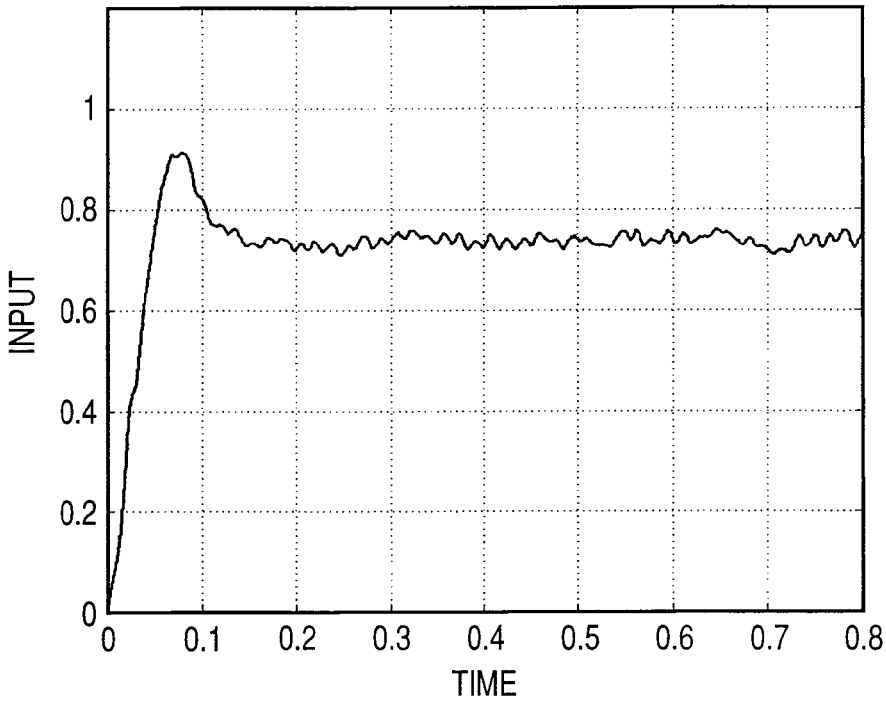
FIG. 6A is a view showing the change in the operation amount when the supply roller is driven with no recording medium P.
Figure 6B:
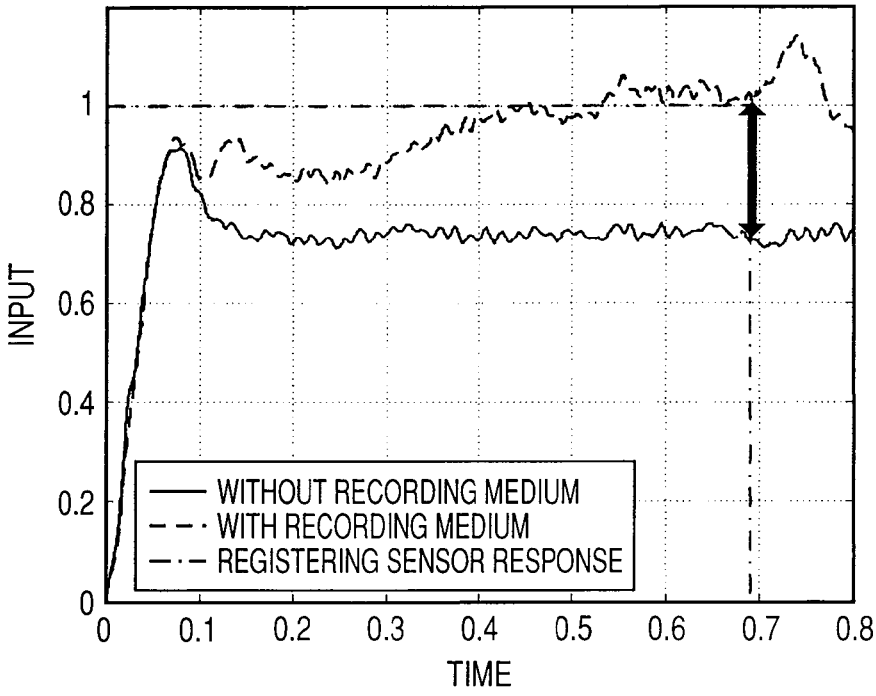
FIG. 6B is a view in which the locus (refer to the dashed line) showing the change in the operation amount when the supply roller 101 is driven with a recording medium P being supplied is overlapped on the locus (refer to the solid line) shown in FIG. 6A.
Figure 7A:
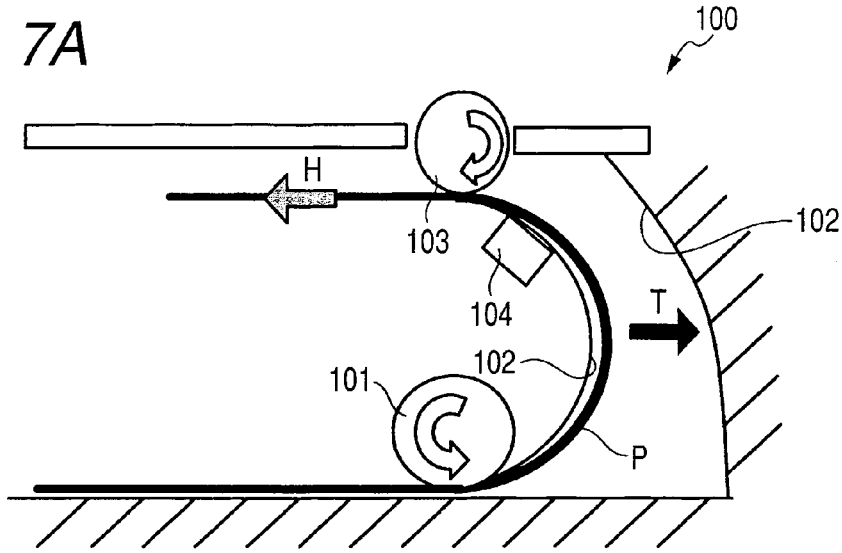
FIGS. 7A and 7B are schematic views showing the mechanism of an internal of a recording medium conveying device 100 including a conveying guide 102.
Figure 7B:
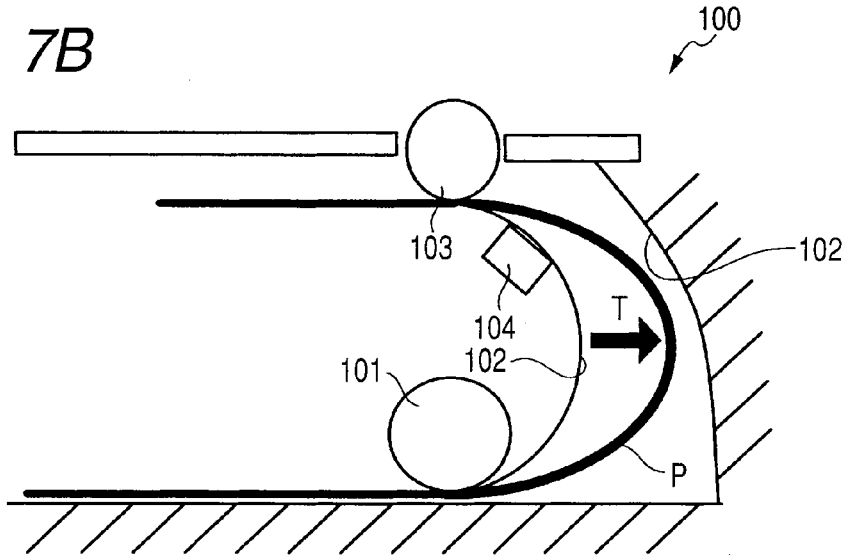

Here will be described that the conveyance load can be estimated by the processing of S503 with reference to FIG. 6A and FIG. 6B. FIG. 6A is a view showing the change in the operation amount when the sheet feeding roller 6 is driven with no recording medium P. FIG. 6B is a view in which the locus (refer to the dashed line) showing the change in the operation amount when the sheet feeding roller 6 is driven with a recording medium P being fed is overlapped on the locus (refer to the solid line) shown in FIG. 6A.

As shown in FIG. 6B, since the operation amount varies depending on the existence of the recording medium P, it can be found that conveyance load bears on the recording medium P due to a back tension. Therefore, assuming the operation amount when the sheet feeding roller 6 is driven with no recording medium P as a reference value, the difference between the reference value and the operation amount when the sheet feeding roller 6 is driven with the recording medium P being fed can be estimated as conveyance load.

The operation amount as a reference value is not always constant due to installation environments of the apparatus and parts wear, etc. To detecting such a varying operation amount as a reference, the operation amount as a reference value when the sheet feeding roller 6 is driven with no recording medium P is detected for every start-up of the conveying motor 77. Therefore, a value consistent with the actual state can be obtained, and the accuracy of conveying is further improved.

Referring again to FIG. 5 for further description, a control parameter is calculated by subtracting a predetermined correction amount from the difference (conveyance load) between the reference value and the operation amount (S504). Here will be described the reason for subtracting the correction amount from the difference (conveyance load) between the reference value and the operation amount.

As shown in FIG. 6B, the operation amount (refer to the dashed line in the figure) when the recording medium P is conveyed is not constant. In the aspect, the registering sensor 72 is arranged in the vicinity before the conveying roller 27. The difference (refer to the arrow in the drawing) between the operation amount at the position of the registering sensor 72 and the reference value is estimated as conveyance load. As shown in FIG. 6B, the conveyance load estimated on that position is larger than that at any other position. Therefore, if the conveyance load calculated in S503 is directly employed as a control parameter, there may be an excessive compensation. Hence, a correction amount is experimentally obtained in advance and the correction amount is subtracted from the difference (conveyance load) between the reference value and the operation amount to prevent the occurrence of such an excessive compensation.

It is then determined whether the driving of the conveying roller 27 is stopped (S505), and if not stopped (S505: No), the processing of S505 is repeated until it is stopped. When the driving is stopped (S505: Yes), the control parameter is updated (S506) the processing is stopped. That is, the multifunction peripheral apparatus 1 according to the aspect is arranged in such a manner that the sheet feeding roller 6 and the conveying roller 27 are driven by one conveying motor 77, the conveying roller 27 is configured to stop once before the conveying by the conveying roller 27 is started. By updating the control parameter at this timing, the control parameter is smoothly updated.

As described above, in accordance with the multifunction peripheral apparatus 1 includes the recording medium conveying device according to the aspect, the conveyance load borne on the recording medium P is estimated by the processing of S503 in FIG. 5 at a time after a start of feeding the recording medium P by the sheet feeding roller 6 and before an arrival of the record medium P at the conveying roller 27, and then the operation amount of the conveying motor 77 for driving the conveying roller 27 is generated based on the estimated conveyance load. Therefore, it is possible to drive the conveying roller 27 while considering the conveyance load borne on the recording medium P before the conveying roller 27 is driven. It is thus possible to control the conveying of the recording medium P by the conveying roller 27 in the same state as if there is no conveyance load, which allows the accuracy of conveying the recording medium P to be improved.

Although aspects of the present invention has been described above based, the present invention is not limited to the present embodiment, and it can easily be conceived that various improvements and modifications may be made without departing from the scope of the present invention.

For example, in the processing of S504 in FIG. 5, the case of calculating a control parameter by subtracting a correction amount that is experimentally obtained in advance from the conveyance load estimated in S503 is described. However, the method for calculating a control parameter from the conveyance load estimated in S503 is not restricted thereto. For example, it may be arranged that a general formula for calculating a control parameter from the conveyance load estimated in S503 is experimentally obtained and a control parameter is calculated based on the general formula. In this case, it is possible to calculate a control parameter that meets the actual state more appropriately, whereby the conveying can be controlled with a higher degree of accuracy.

What is claimed is:

1. A recording medium conveying device comprising:

a feeding roller that feeds a recording medium;

a conveying guide that guides the recording medium, fed by the feeding roller, in a U-shape;

a conveying roller that conveys the recording medium passing through the conveying guide toward a target position;

a driving unit that drives the feeding roller and the conveying roller; and a controller that is operable to:

detect a first operation amount of the driving unit when the feeding roller or the conveying roller is driven without the recording medium;

detect a second operation amount of the driving unit when the feeding roller feeds the recording medium;

estimate a conveyance load borne on the recording medium based on a difference between the first operation amount and the second operation amount at a time after a start of feeding the recording medium and before an arrival of the record medium at the conveying roller; and generate an operation amount of the driving unit to drive the conveying roller based on the estimated conveyance load.

2. The device according to claim 1, wherein the controller is further operable to:

calculate a correction amount for the operation amount based on the estimated conveyance load; and generate the operation amount based on the correction amount.

3. The device according to claim 2, wherein the controller is further operable to:

calculate the correction amount based on an amount that is calculated by subtracting a predetermined amount from the estimated conveyance load.

4. The device according to claim 1, wherein the first operation amount is detected at every start-up of the driving unit.

5. The device according to claim 1, further comprising:

a detecting section that detects an arrival of the recording medium to a location upstream from the conveying roller;

wherein the second operation amount is detected when the recording medium is detected by the detecting section.

6. A method for generating an operation amount in a recording medium conveying device, the method comprising:

feeding a recording medium in a U-shape path through a conveying guide to a conveying roller by a feeding roller;

detecting a first operation amount of the driving unit when the feeding roller or the conveying roller is driven without the recording medium;

detecting a second operation amount of the driving unit when the feeding roller feeds the recording medium;

estimating a conveyance load borne on the recording medium based on a difference between the first operation amount and the second operation amount at a time after a start of feeding the recording medium and before an arrival of the record medium at the conveying roller;

generating an operation amount for a driving unit that drives the feeding roller and the conveying roller; and conveying the recording medium toward a target position by driving the conveying roller based on the conveyance load.

* * * * *